US009692154B2

(12) United States Patent
Page

(10) Patent No.: US 9,692,154 B2
(45) Date of Patent: Jun. 27, 2017

(54) SAFE JUMPER METHODOLOGY UTILIZING SWITCH EMBEDDED CONNECTION CLAMPS

(71) Applicant: Twitch Technologies LLC, Hampton, SC (US)

(72) Inventor: John Dennis Page, Guyton, GA (US)

(73) Assignee: TWITCH TECHNOLOGIES LLC, Hampton, SC (US)

( * ) Notice: Subject to any disclaimer, the term of this patent is extended or adjusted under 35 U.S.C. 154(b) by 0 days.

(21) Appl. No.: 14/987,119

(22) Filed: Jan. 4, 2016

(65) Prior Publication Data

US 2016/0197415 A1 Jul. 7, 2016

Related U.S. Application Data

(60) Provisional application No. 62/099,617, filed on Jan. 5, 2015.

(51) Int. Cl.
*H01R 4/48* (2006.01)
*H01R 11/24* (2006.01)

(52) U.S. Cl.
CPC ..... *H01R 11/24* (2013.01)

(58) Field of Classification Search
CPC ..... H01R 11/22; H01R 11/24
USPC ..... 439/822, 759, 188, 504
See application file for complete search history.

(56) References Cited

U.S. PATENT DOCUMENTS

| | | | | |
|---|---|---|---|---|
| 4,163,134 A * | 7/1979 | Budrose | H02J 7/0034 | 200/505 |
| 5,601,452 A * | 2/1997 | Ruffa | H01R 11/24 | 439/504 |
| 5,772,468 A * | 6/1998 | Kowalski | H01R 11/24 | 439/506 |
| 7,422,474 B1 * | 9/2008 | Good | H01R 11/24 | 439/504 |
| 8,083,555 B2 * | 12/2011 | Schouten | H01R 11/24 | 439/822 |

* cited by examiner

*Primary Examiner* — Phuong Dinh
(74) *Attorney, Agent, or Firm* — Nixon & Vanderhye P.C.

(57) ABSTRACT

A clamp includes a first and second handle parts that are pivotable relative to each other and biased closed. A first electrical contactor is associated with the first handle part, and a second electrical contactor is associated with the second handle part. The first electrical contactor and the second electrical contactor are positioned such that in the closed position of the clamp, a circuit connection between the first electrical contactor and the second electrical contactor is open, and in the open position, the circuit connection is closed.

4 Claims, 3 Drawing Sheets

SAFE JUMPER METHODOLOGY UTILIZING SWITCH EMBEDDED CONNECTION CLAMPS

CROSS-REFERENCES TO RELATED APPLICATIONS

This application claims the benefit of U.S. Provisional Patent Application No. 62/099,617, filed Jan. 5, 2015, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

I. Field

This invention pertains generally to electronic circuitry accessories, more specifically to manual clamp-on "jumper wires" and "jumper cables". More specifically, this invention pertains to a new class of jumper wires and cables that can eliminate inadvertent electronic power transfer and/or arcing. This new class of jumper devices when used in conjunction with low amperage electronic circuit applications, may be known as "Jumper Pups" and when used in higher amperage applications, such as with car batteries, may be known as "Jumper Dogs". The invention also relates to a clamp with an integrated switch that allows current to flow (or in certain applications, not flow) based on a relative position of the clamp handles.

II. Background

Almost everyone who has "jump-charged" a car battery has had the unfortunate experience of inadvertently touching the positive and negative clamps together, or even worse, dropping one of the clamps into the engine compartment. Improper connections can result in "shorting", causing small wires to burn up quickly. Shorting large wires capable of carrying lots of current can even be worse, producing flying shards of molten metal. Shorting the terminals of the battery can quickly overheat it, causing a fire, or battery explosion.

The sparking, arcing, and ensuing panic is bad enough, but with today's vehicles, improper jumper cable use can also result in serious damage to a car's electronics.

As automobiles continue to evolve, they are increasingly reliant upon on-board computers and processors. A modern luxury automobile may contain up to a hundred processors, and even the least expensive vehicles will contain dozens of processors. Although some of these processors are used in non-essential systems such as entertainment systems, wiper controls, etc., other processors are integral to the proper functioning of critical systems, including the engine.

Not unlike automotive jumper cables, technicians working on computers and other processor-based systems, often use small jumpers for troubleshooting and testing. If a "live" jumper is inadvertently dropped onto a circuit board, substantial damage may occur within the system.

Owing to the fact that "jumping" is a common procedure and that the improper use "jumpers and jumper cables" can cause serious damage to electronic systems, it is apparent that a need exists for a simple, intuitive, reliable, safe "jumper" system. This present invention accomplishes that goal.

Using an automotive application as an example, current automobile jumper cables (jumpers) typically consist of two lengths of insulated heavy gauge cable, with both ends terminating in hand-operated, spring-tensioned, battery terminal clamps. The clamps, which may be squeezed open, contain "teeth" set within jaws designed to grasp the battery terminal posts when the clamps are properly positioned and the hand pressure is released. The jumper cable clamps are normally color coded, with one cable terminating in red clamps, representing the positive (+) connections, and the other cable terminating in black clamps, representing the negative (−) connections.

Jumper cables have become a commodity, differentiated only by a few items such as the gauge of the cable, the type and color of the insulating material, and occasionally, the style of the clamps. This present invention makes a true differentiation.

Previous attempts have been made at creating a safe jumper cable. One approach involves cables that incorporate a switch, which in one position interrupts the cables' continuity (circuit flow). Once the user has ascertained that all jumper clamps are appropriately and securely attached to the battery terminals (posts), they may "throw" the switch into the alternate position, enabling the cables' continuity.

BRIEF SUMMARY OF THE INVENTION

A purpose of this present invention is to provide a new class of electrical jumpers, which substantially increase the safety of connected electronic components, and in the case of high current applications, the safety of the user as well. The invention offers the level of protection that would be afforded by a circuit disconnection switch integrated into the jumper wire or cable, but with the convenience of being operated by the simple squeezing of the clamp handles. The invention also relates to a clamp generally with an integrated switch that allows current to flow (or in certain applications, not flow) based on a relative position of the clamp handles. The described embodiments are applicable to any instance that necessitates temporary attachment of the electrical cables by means of a clamp.

The present invention, may offer particular benefit when used with high-current automotive procedures such as "battery jumping". In such an automotive embodiment, called Jumper Dogs, the system takes the form of, and operates in the same manner as, traditional automotive jumper cables. The primary difference is Jumper Dogs' novel terminal clamps, which also function as a switch. Other automotive applications of the described embodiments that typically include clamps are battery chargers, portable auxiliary batteries, and the like. Alternative applications will also be apparent, including, without limitation, a clamp for linemen with power companies where the clamp prevents AC current flow until the clamp is in a use position, e.g., clamp is open to attach to a cable or terminal.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
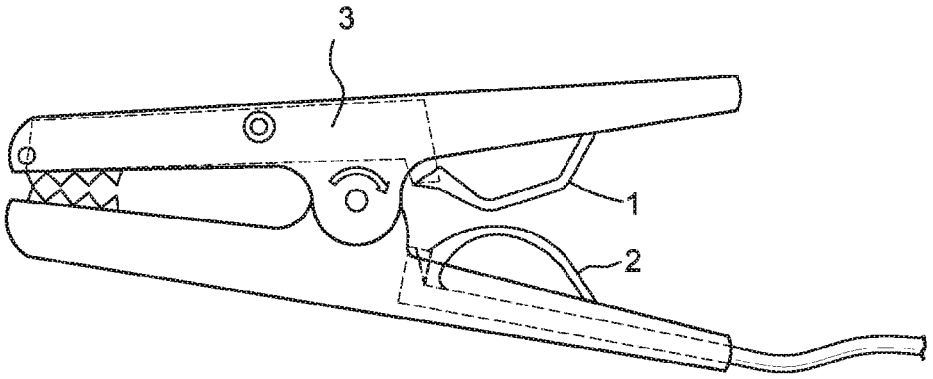
FIGS. 1 and 2 show a first embodiment utilizing leaf spring contactors.

In a normal, resting state, no continuity exists between the electrical cable and the clamps' teeth (Jumper Dogs' teeth).

However, as the clamp is squeezed, the clamp's jaw begins to open. When a threshold, based on the size of the amount of opening, is passed, a conductive electrical bridge becomes established between the electrical cable, and the clamp's teeth. Thus electrical current can flow only when the clamp jaws are opened by the action of squeezing the handles. If the clamp's open jaws are opened, such as when being placed on a battery post/terminal, electrical continuity is established, and current to or from the connected post and cable is able to flow freely. If the clamp is taken away from the battery post and is released so that the spring tensioned jaws return to their normal closed state, then all continuity is lost.

Please note, from an electrical perspective, when the jaws of the clamp are open, the circuit is closed. When the jaws are closed the circuit is open. Regardless of the application, automotive or otherwise, in this present invention, each terminal clamp uniquely functions as a switch so that as the clamp is squeezed open, a threshold is passed, causing the normally open switch (incapable of carrying current), to become closed, allowing the current to flow to and from the clamp's "teeth" and through the cable. Again, it is the process of squeezing that opens jumper clamp's jaw and closes the circuit that allows the current to flow.

There are many ways to perform the action of closing a circuit by the squeezing of a spring-tensioned clamp handle. Several electro-mechanical approaches are illustrated in the drawings (described below).

It should be obvious to those skilled in the art that it may also be possible to incorporate an electronic (non-mechanical) switch into the clamp that may open or close a circuit, based upon the sensing of physical pressure from the hand, or from a change of resistance or other state caused by the position of the clamp's jaws.

Exemplary embodiments will be described with reference to the drawings. Typical jumper cables include clamps at ends thereof that are biased toward a closed (i.e., clamped) position. The clamps typically include insulated handles at one end and gripping teeth or the like at an opposite end. The clamps are biased to the closed position by a leaf spring or the like.

Figure 2:
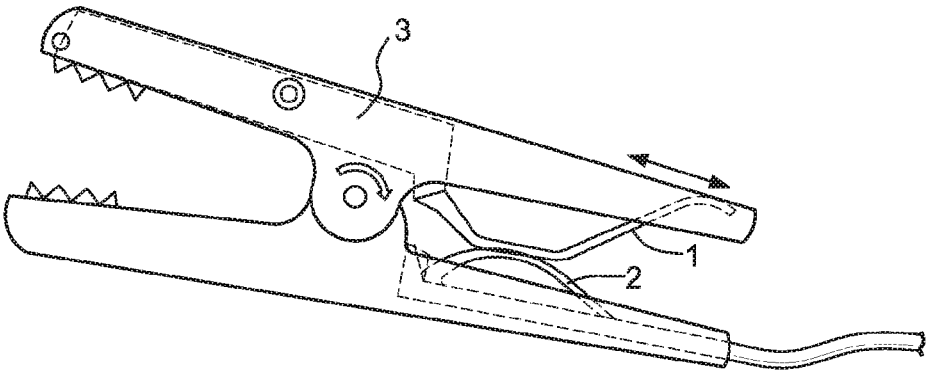

In an exemplary embodiment, with reference to FIGS. 1 and 2, as the handle is squeezed to open the clamp, a leaf spring contactor 1 on one side of the handle engages a leaf spring contactor 2 on an opposite side of the handle, thereby completing the electrical circuit and energizing an upper bussbar 3. As shown in FIG. 2, one end of each leaf spring contactor 1, 2 is affixed to the handle frame, while the other end is allowed to slide outward as it is compressed. The mating portions may be housed in a non-conductive sheath to contain possible sparking.

Figure 3:
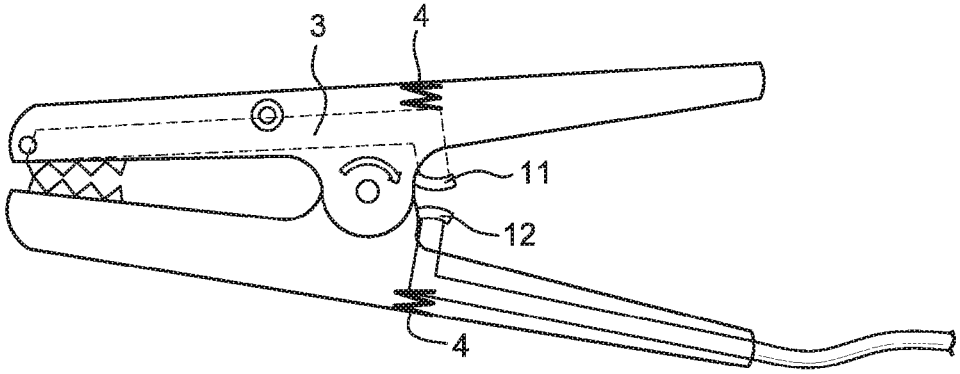
FIGS. 3 and 4 show an alternative embodiment with selectively engageable contactors.
Figure 4:
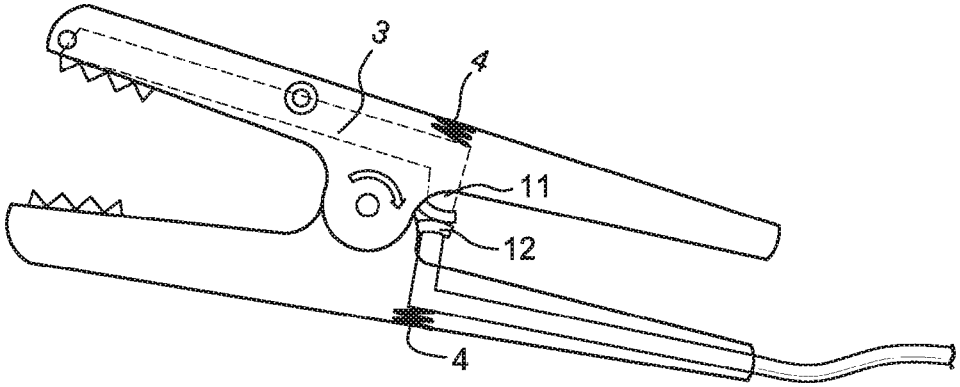

In the embodiment shown in FIGS. 3 and 4, as the handle is squeezed, a contactor 11 mates with a complementary contactor 12, thereby completing the circuit and energizing the upper bussbar 3. A compressive spring 4 may be included to provide haptic feedback to the user as mating occurs. Alternatively, the contactors 11, 12 may be designed so that they "flex," negating the need for an additional spring. These springs are unrelated to the "primary spring" that provides the clamping force necessary to press the teeth into the battery terminal.

Figure 5:
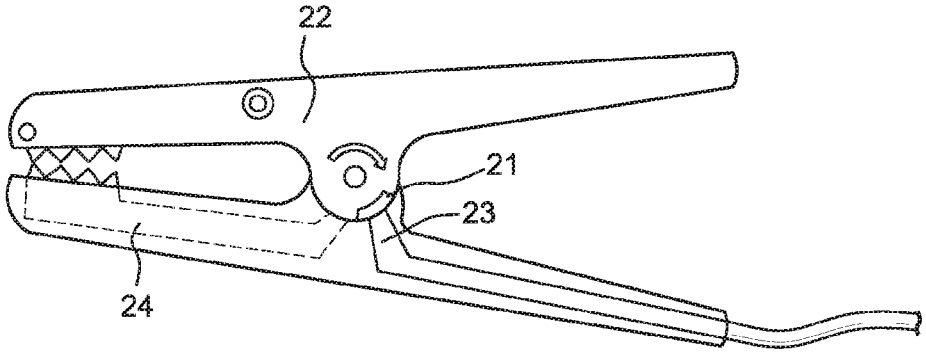
FIGS. 5 and 6 show yet another alternative embodiment utilizing an electrically conductive bridge.
Figure 6:
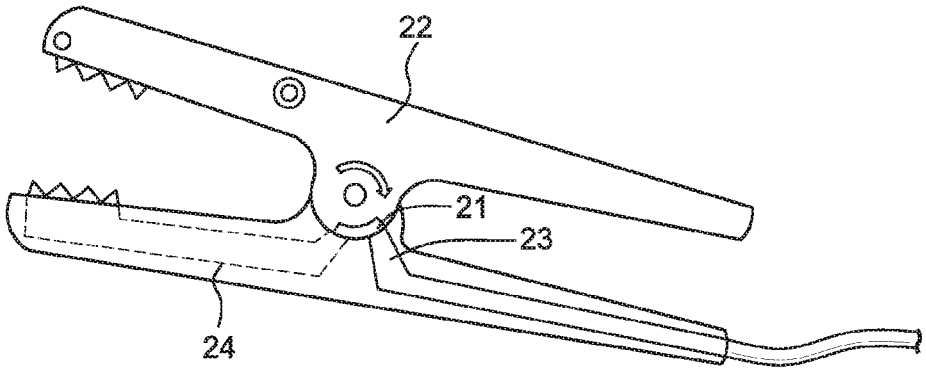

FIGS. 5 and 6 show yet another alternative embodiment. As the handle is squeezed, an electrically conductive material 21 mounted in the upper handle assembly 22 and already in contact with a first bussbar 23, pivots around and acts as a bridge to become electrically connected with the second (front) bussbar 24.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A clamp comprising:

a first handle part of the clamp including a bussbar connector;

a second handle part of the clamp connected to the first handle part at a pivot joint, wherein the second handle part is pivotable relative to the first handle part to displace the clamp between a closed position and an open position;

a spring connected between the first handle part and the second handle part, the spring biasing the clamp to toward the closed position;

a first electrical contactor associated with the first handle part; and a second electrical contactor associated with the second handle part, wherein the first electrical contactor and the second electrical contactor are positioned such that in the closed position of the clamp, a circuit connection between the first electrical contactor and the second electrical contactor is open, and in the open position, the circuit connection is closed.

2. A clamp according to claim 1, wherein the first electrical contactor is electrically coupled with the bussbar connector, and wherein the first and second electrical contactors comprise leaf springs respectively connected to the first handle part and the second handle part.

3. A clamp according to claim 1, wherein the first electrical contactor is electrically coupled with the bussbar connector, wherein in the open position of the clamp, the first electrical contactor is spaced from the second electrical contactor, and wherein in the closed position of the clamp, the first electrical contactor is electrically coupled with the second electrical contactor.

4. A clamp according to claim 1, wherein the bussbar connector comprises a first bussbar connector, and wherein the first electrical contactor comprises a second bussbar connector, the second electrical contactor comprising a bridge connector that is positioned to electrically connect the first bussbar connector and the second bussbar connector in the closed positioned of the clamp.

* * * * *